US012569895B2

(12) United States Patent
Roscioli et al.

(10) Patent No.: US 12,569,895 B2
(45) Date of Patent: Mar. 10, 2026

(54) SYSTEMS, COMPOSITIONS, AND METHODS FOR PRODUCING SHARP EDGES

(71) Applicant: MASSACHUSETTS INSTITUTE OF TECHNOLOGY, Cambridge, MA (US)

(72) Inventors: Gianluca Roscioli, Cambridge, MA (US); Cemal Cem Tasan, Cambridge, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 519 days.

(21) Appl. No.: 17/761,271

(22) PCT Filed: Sep. 18, 2020

(86) PCT No.: PCT/US2020/051519

§ 371 (c)(1),
(2) Date: Mar. 17, 2022

(87) PCT Pub. No.: WO2021/055769

PCT Pub. Date: Mar. 25, 2021

(65) Prior Publication Data

US 2022/0371146 A1 Nov. 24, 2022

Related U.S. Application Data

(60) Provisional application No. 62/902,018, filed on Sep. 18, 2019.

(51) Int. Cl.
*B21B 1/22* (2006.01)
*B21C 37/00* (2006.01)
(Continued)

(52) U.S. Cl.
CPC ..... *B21B 1/22* (2013.01); *B21C 37/00* (2013.01); *B21J 1/02* (2013.01); *B24B 3/36* (2013.01)

(58) Field of Classification Search
None
See application file for complete search history.

(56) References Cited

U.S. PATENT DOCUMENTS 3,461,616 A 8/1969 Warren, I et al.
3,481,813 A 12/1969 Wiggers
(Continued)

FOREIGN PATENT DOCUMENTS

CN 1329676 C 8/2007
CN 109666779 A * 4/2019 ..... A61B 17/3201
(Continued)

OTHER PUBLICATIONS

Merriam-Webster Dictionary, "Notch", <https://www.merriam-webster.com/dictionary/notch>, accessed Nov. 13, 2024.*
(Continued)

*Primary Examiner* — Xiaobei Wang
(74) *Attorney, Agent, or Firm* — Barnes & Thornburg LLP

(57) ABSTRACT

The present disclosure is directed to systems, compositions, and methods for manufacturing objects with sharp edges having a high strength and hardness. To form the sharp edge, an object can be subjected to a compressive force that locally deforms the object to create the sharp edge. In some embodiments, deformation can occur by passing the material through a system of one or more opposed tapered rolls having one or more tapering angles for deforming the material. The tapered rolls can rotate and drive the material downstream to a next opposed pair of tapered rolls. The tapered rolls deform the material by changing the material microstructure, compressing the grains of the material in a predetermined location to create a more homogeneous microstructure. The local modification of the resulting microstructure increases the homogeneity as well as the
(Continued)

hardness and strength of the material and prevents cracking and/or chipping of the material.

20 Claims, 5 Drawing Sheets

(51) Int. Cl.
*B21J 1/02* (2006.01)
*B24B 3/36* (2006.01)

(56) References Cited

U.S. PATENT DOCUMENTS

| | | | | |
|---|---|---|---|---|
| 5,108,781 | A | 4/1992 | Ranjan et al. | |
| 6,684,513 | B1 | 2/2004 | Clipstone et al. | |
| 9,079,321 | B2 | 7/2015 | Claus et al. | |
| 2004/0163436 | A1 | 8/2004 | Utyashev et al. | |
| 2005/0207858 | A1 | 9/2005 | Muller et al. | |
| 2005/0230510 | A1* | 10/2005 | Flanhardt | B21D 53/647 241/242 |
| 2006/0283529 | A1 | 12/2006 | Ghosh et al. | |
| 2007/0163390 | A1* | 7/2007 | Hobbs | B26B 21/54 76/104.1 |
| 2007/0209741 | A1 | 9/2007 | Carpenter et al. | |
| 2013/0118657 | A1 | 5/2013 | Mishra et al. | |
| 2014/0182474 | A1 | 7/2014 | Dunaway et al. | |
| 2015/0114199 | A1 | 4/2015 | Shepard et al. | |
| 2016/0340564 | A1 | 11/2016 | Louapre et al. | |

FOREIGN PATENT DOCUMENTS

| | | | | |
|---|---|---|---|---|
| EP | 0912270 | B1 | | 3/2002 |
| EP | 2853363 | A1 | | 4/2015 |
| GB | 518625 | A | | 3/1940 |
| GB | 9400012 | | | 3/1994 |
| JP | S50146409 | A | | 11/1975 |
| JP | S5762801 | U | | 4/1982 |
| JP | H01154801 | A | * | 6/1989 |
| JP | H1154801 | A | | 2/1999 |
| JP | 2000212673 | A | | 8/2000 |
| JP | 2002069531 | A | | 3/2002 |
| JP | 2002129277 | A | | 5/2002 |
| JP | 2002224704 | A | | 8/2002 |
| JP | 2002525210 | A | | 8/2002 |
| JP | 2006300128 | A | | 11/2006 |
| JP | 2018043795 | A | | 3/2018 |
| JP | 2019510638 | A | | 4/2019 |
| JP | 2022517433 | A | | 3/2022 |
| KR | 20060081794 | A | | 7/2006 |
| KR | 20090093487 | A | | 9/2009 |
| KR | 101383165 | B1 | | 4/2014 |

OTHER PUBLICATIONS

Corrosionpedia, "Pearlite", <https://www.corrosionpedia.com/definition/863/pearlite>, Sep. 16, 2017, web.archive.org, accessed Nov. 18, 2024. (Year: 2017).*
PCT International Search Report and Written Opinion completed by the ISA/US on Jan. 6, 2021 and issued in connection with PCT/US2020/051519.
Chinese Office Action and Search Report issued for 2020800778134, dated Nov. 11, 2022 (12 pages).
Chinese Search Report for Application No. 202080077813, dated Nov. 1, 2022 (2 pages).
Hohenwarter, et al., "Ultra-strong and damage tolerant metallic bulk materials: a lesson from nanostructured pearlitic steel wires," Scientific Reports 6, Article No. 33228 (2016).
Jahanmir, et al., "Mechanics of subsurface void nucleation in delamination wear," Wear, vol. 44, No. 1, pp. 17-38, Aug. 1977.
Jo, et al., "Dissociation of Cr-rich M23C6 carbide in Alloy 617 by severe plastic deformation," Journal of Nuclear Materials, 406(3), 360-364.
Langford, "Deformation of pearlite," Metallurgical Transactions A. 8 (1977) 861-875.
Li, et al., "Atomic-scale mechanisms of deformation-induced cementite decomposition in pearlite," Acta Materialia. 59 (2011) 3965-3977.
Li, et al., "Segregation Stabilizes Nanocrystalline Bulk Steel with Near Theoretical Strength," Phys Rev Lett vol. 113 p. 106104 (2014).
Moore, Comparative analysis of razor blade coatings using Auger electron spectroscopy. Thin Solid Films. 270, 331-334 (1995).
N. P. Suh, "An overview of the delamination theory of wear," Wear, vol. 44, No. 1, pp. 1-16, Aug. 1977.
Nakase, et al., "The effect of alloying elements and microstructure on the strength and fracture resistance of pearlitic steel," Metallurgical Transactions A. 19 (1988) 2819-2829.
Nematollahi et al., "Thermodynamics of carbon solubility in ferrite and vacancy formation in cementite in strained pearlite," Acta Mater 61 (2013) 1773.
Nematollahi, et al., "Multiscale description of carbon-supersaturated ferrite in severely drawn pearlitic wires," Acta Materialia. 111 (2016).
Roscioli, et al., "How hair deforms steel," Science (2020) vol. 369, Issue 6504, pp. 689-694. DOI: 10.1126/science.aba9490.
Roscioli, et al., "Your hair can crack steel when it hits the right spot," Science Magazine, 2020, research: DOI: 10.1126/science.aba9490, footage: Duke University Libraries/Internet Archive [Online] https://www.youtube.com/watch?v=6kgw6j9n_20.
Roscioli et al., "Chemo-mechanical effects on the cutting-induced mixed-mode II-III fracture of martensitic stainless steels: an in-situ investigation," Acta Materialia. 231 (2022).
Notice of Reasons of Refusal for Japanese Application. 2022-517433 dated Oct. 15, 2024 (12 pages).

* cited by examiner

SYSTEMS, COMPOSITIONS, AND METHODS FOR PRODUCING SHARP EDGES

CROSS REFERENCE TO RELATED APPLICATION

This application is a U.S. national counterpart application of international application serial No. PCT/US2020/051519 filed Sep. 18, 2020, which claims priority to and the benefit of U.S. Provisional Patent Application No. 62/902,018, filed on Sep. 18, 2019, the disclosures of which are hereby expressly incorporated by reference in their entireties.

FIELD

The present disclosure relates to systems, compositions, and methods for manufacturing objects having sharp edges, and more particularly relates to local deformation of a material to form a sharp edge(s) at a desired location thereof without substantially changing the composition and/or mass of the material.

BACKGROUND

The manufacture of materials having various sharpness has been performed by humans for thousands of years. From spears that were used for hunting, to swords, axes, needles, and to modern-day thumbtacks, materials have been engineered to be used as tools having the ability to cut, pierce, and bind everyday objects to enhance quality of life. Within the last few centuries, innovations such as the kitchen knife, scissors, and the razor blade have exploited the ability of materials such as metals to change the way we cook, work, and groom. However, with the global population continuing to increase, the demand for manufacture of such tools has risen, and the environmental impacts and energy expended to manufacture these tools have correspondingly increased. Increasing the lifespan of these materials can have positive environmental impacts. For example, with respect to razor blades, in 1990, the Environmental Protection Agency (EPA) estimated that approximately two billion razor blades were being discarded annually worldwide. Three decades later, little progress has been made with respect to increasing longevity of razor blades. While state of the art technologies have improved the closeness of shaves, dulling of razor blades still plagues the industry, and thereby the environment.

Existing methods for producing sharp edges have several shortcomings. Conventional methods involve stripping materials to form a wedge shape that can be used for cutting or piercing. The most common manufacturing method of this nature for forming sharp edges, especially with respect to razor blades, involves a process referred to as "honing." In honing, a starting material begins in strip or plate form and is heat treated until a desired microstructure and hardness is obtained. Abrasive wheels are then used to remove material from specific locations to form a wedge geometry. Due to uneven exposure times and incongruencies in the microstructure that makes up the material, honed materials frequently have uneven edges that can wear down over time when exposed to frequent and regular stresses and strains. For example, repeated contact with the uneven edges of the honed material can result in cracking and chipping that propagates throughout the material and render it dull and inefficient after several uses. Honing procedures also require a large amount of energy to operate the heat treatment and abrasion, and often results in wasted material because the removed material is often discarded.

Accordingly, there is a need for systems, compositions, and methods for producing a sharp edge(s) that has high strength and hardness while not being susceptible to cracking and/or chipping.

SUMMARY

The present application is directed to systems, compositions, and methods for manufacturing objects having sharp edges that are resistant to cracking and/or chipping. In at least some instances, the material undergoes severe plastic deformation at the tip to allow for a sharp edge having a high strength and hardness. Deformation of the material can occur by passing the material through a system of one or more tapered rolls that locally deform the material to produce the sharp edge. The tapered rolls can include a cylindrical body that exerts a compressive force onto the material to deform the material at a desired location thereof. The tapered rolls can have one or more tapering angles for deforming the material. The tapered rolls can be positioned in opposed pairs, such that the material is received between each pair of rolls that contact the material on opposing surfaces thereof. The tapered rolls can be configured to rotate to drive the material in the direction of rotation. In some embodiments, the system can include a plurality of pairs of tapered rolls that deform the material. In such embodiments, each pair of tapered rolls can be positioned downstream of one another such that rotation of the upstream pair of rolls drives the material to the downstream pair of rolls. In some embodiments, the tapering angle of the last pair, or last pairs, of rolls can be different than the tapering angle for the initial pair, or initial pairs, of rolls to provide for a possible "separation" in two sides and/or impart a specific angle at a very tip of a sharp edge.

Use of the tapered rolls can localize the severe plastic deformation at the sharp edge to induce cementite dissolution and obtain a strong homogeneous material where needed. For example, the microstructure of the material prior to deformation is composed of heterogeneous grains of various size and hardness that are interspersed throughout the material with spaces or voids between individual grains (grain boundaries). These spaces result in weakness of the overall structure of the material, which when stressed can displace the grains into the spaces, causing cracks to form in the material and therefore chips at the sharp edge. Contact with the tapered roll(s) compresses the grains in a predetermined location into a smaller size (grain refinement), allowing them to fill the spaces and create a more homogeneous microstructure. This process increases both the homogeneity of the resulting microstructure as well as the hardness and strength of the material and prevents cracking and/or chipping of the material.

One exemplary embodiment of a deformed material includes a length of metallic material, the length of metallic material having a substantially homogeneous microstructure in at least a deformed portion thereof, with the substantially homogenous microstructure having a plurality of deformed grains of a substantially uniform size that are smaller in size than the grains in one or more of a non-deformed portion of the length of metallic material and the grains in the deformed portion prior to deformation.

The length of metallic material can include one or more of pure iron, steel, stainless steel, copper, martensite, chromium, carbides, nitrides, metallic glasses, polymers, pearlite, cementite, martensitic steel, aluminum, pearlitic steel, titanium, nickel, cobalt, hydroxyapatite, silver, or gold. The size of the plurality of deformed grains can be approximately in the range of about 75% of the average grain size of the deformed grains to about 125% of the average grain size of the deformed grains. In some embodiments, the size of the deformed grains can be approximately 25% of the size of the grains in the non-deformed portion. In alternate embodiments, the size of the deformed grains can be approximately 25% of the size of the grains prior to deformation.

One exemplary embodiment of a system for manufacturing a sharp edge includes a first pair of opposed tapered rolls and at least one additional pair of opposed tapered rolls disposed laterally downstream of the first pair of opposed tapered rolls. The first pair of opposed tapered rolls are configured to rotate to drive a material disposed between them downstream. The first pair of opposed tapered rolls also have one or more features configured to deform the material while the material is being driven downstream. The at least one additional pair of opposed tapered rolls are configured to rotate to drive a material received from the first pair of opposed tapered rolls downstream. Each roll of the first pair of opposed tapered rolls includes a somewhat cylindrical configuration that includes a first end, a second end, and an apex, with the opposed surface of each roll being tapered between the first end and the apex and between the second end and the apex. A distance between each roll of the first pair of opposed tapered rolls as measured from an apex along opposed surfaces of each roll of the first pair of opposed tapered rolls is greater than a distance between each roll of the at least one additional pair of opposed tapered rolls as measured from an apex along opposed surfaces of each roll of the at least one additional pair of opposed tapered rolls.

The one or more features can include a first tapering angle that extends along an outer surface of the tapered roll between the apex and one or more of the first end and the second end of the tapered roll. Further, the apex and the outer surface of the tapered roll can be configured to exert a compressive force to deform the material. In some embodiments, the tapered roll can include a second tapering angle that extends between the first tapering angle and one or more of the first end and the second end of the tapered roll. The tapering angle can have a value that is different from a value of the first tapering angle. A value of the first tapering angle can be approximately in the range of about 3 degrees to about 60 degrees. In some embodiments, a value of the first tapering angle can be approximately in the range of about 5 degrees to about 30 degrees.

The at least one additional pair of opposed tapered rolls of the system can include at least five pairs of opposed tapered rolls. In at least some such embodiments, each pair can be disposed downstream from one another and the distance between each roll of the respective pair of the at least five pairs of opposed tapered rolls can decrease for each subsequent downstream pair of the at least five pairs of opposed tapered rolls. Each roll of the first pair of opposed tapered rolls can rotate in a direction opposite of the opposite tapered roll of the first pair of opposed tapered rolls to drive the material downstream. In some embodiments a distance between each roll of a terminal pair of opposed tapered rolls of the at least one additional pair of opposed tapered rolls can be effectively zero. In some embodiments, at least one roll of the first pair of opposed tapered rolls can include a plurality of tapers, each taper having a plurality of tapering angles.

The system can be such that substantially no portion of the material is removed during deformation. In some embodiments, a mass of the deformed material can be substantially the same as a mass of the material prior to deformation. The material can include one or more of pure iron, steel, stainless steel, copper, martensite, chromium, carbides, nitrides, metallic glasses, polymers, pearlite, cementite, martensitic steel, aluminum, pearlitic steel, titanium, nickel, cobalt, hydroxyapatite, silver, or gold.

One exemplary method of manufacturing an edge includes feeding a length of metallic material between a first pair of opposed tapered rolls and rotating the first pair of opposed tapered rolls to advance the length of metallic material through the first pair of opposed tapered rolls. The pair of opposed tapered rolls cause local deformation on both sides of the length of metallic material. Further, the length of metallic material splits to form two metallic pieces, each metallic piece having a sharp edge that includes a localized deformed region.

In some embodiments, the method can further include receiving the length of metallic material between at least one additional pair of opposed tapered rolls disposed laterally downstream of the first pair of opposed tapered rolls. In such embodiments the method can further include rotating the additional pair(s) of opposed tapered rolls to advance the length of metallic material received through the rolls downstream. The additional pair of opposed tapered rolls can cause further local deformation on both sides of the length of metallic material. Rotating the first pair of opposed tapered rolls and the additional pair(s) of opposed tapered rolls to advance the length of metallic material laterally through the pair(s) can form two specular V-shaped notches along the length of metallic material. The method can further include positioning the length of metallic material relative to the first pair of opposed tapered rolls at a predetermined location along the length of metallic material such that an edge is formed at the predetermined location.

In some embodiments, a first tapering angle can extend along an outer surface of the first pair of opposed tapered rolls between an apex and one or more of a first end and a second end of the first pair of opposed tapered rolls. A portion of the outer surface that includes the first tapering angle can engage the length of metallic material to deform both sides of the length of metallic material. In at least some such embodiments, substantially no local deformation occurs along the length of metallic material outside of the predetermined location.

In some embodiments, substantially no portion of the length of metallic material can be removed during deformation. Alternatively, or additionally, a mass of the length of metallic material after deformation can be substantially the same as a mass of the material prior to deformation. In some embodiments, the length of metallic material can include one or more of stainless steel or pearlitic steel. In some embodiments, the length of metallic material can include copper.

BRIEF DESCRIPTION OF THE DRAWINGS

This disclosure will be more fully understood from the following detailed description taken in conjunction with the accompanying drawings, in which.

DETAILED DESCRIPTION

Figure 1:
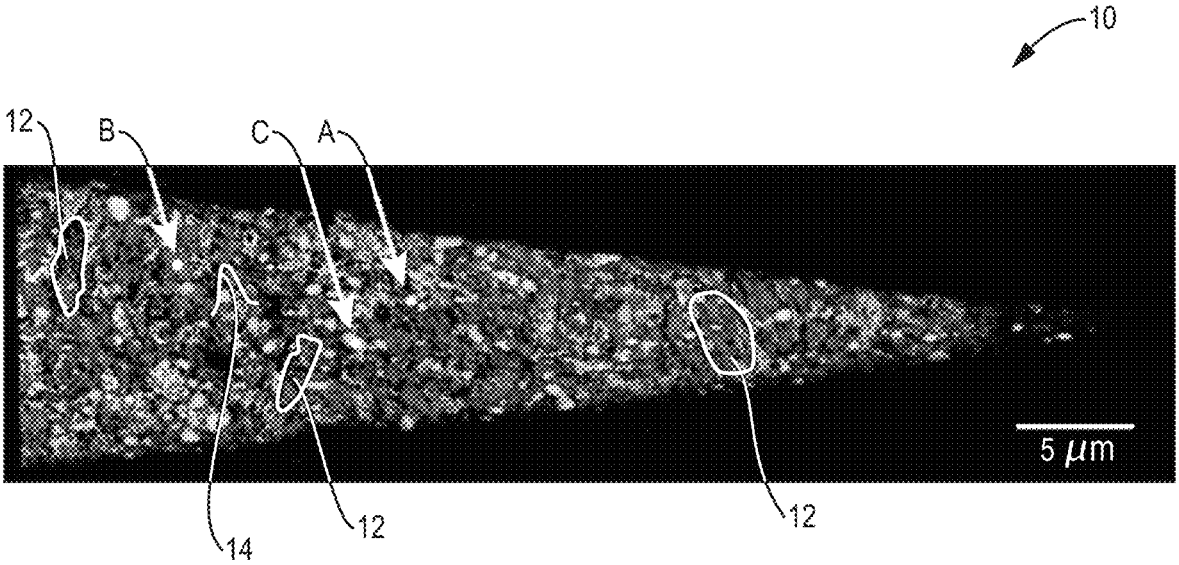
FIG. 1 is a magnified schematic side view of a conventional razor blade showing variations of hardness in a surface thereof.

Certain exemplary embodiments will now be described to provide an overall understanding of the principles of the structure, function, manufacture, and use of the systems, devices, and methods disclosed herein. One or more examples of these embodiments are illustrated in the accompanying drawings. Those skilled in the art will understand that the systems, compositions, and methods specifically described herein and illustrated in the accompanying drawings are non-limiting exemplary embodiments and that the scope of the present disclosure is defined solely by the claims. The features illustrated or described in connection with one exemplary embodiment may be combined with the features of other embodiments. Such modifications and variations are intended to be included within the scope of the present disclosure.

To the extent that the instant disclosure includes various terms for components and/or processes of the disclosed compositions, systems, methods, and the like, one skilled in the art, in view of the claims, present disclosure, and knowledge of the skilled person, will understand such terms are merely examples of such components and/or processes, and other components, designs, processes, and/or actions are possible. By way of non-limiting example, a person skilled in the art, in view of the present disclosures, will understand that any number of tapered roll or drum pairs can be used, the terms "roll" and "drum" being used interchangeably within the present disclosure. Further, a person skilled in the art, in view of the present disclosures, will understand that the terms "space" and "void" can be used interchangeably within the present disclosure to refer to gaps between grains in the microstructure of the material. Additionally, while the systems, compositions, and methods in the present disclosure are discussed with respect to manufacturing sharp edges for razor blades, a person skill in the art will recognize that the sharp edges of the present disclosure can be used in other fields and/or for other purposes in which sharp edges are desired. For example, in addition to razor blades, the sharp edges that result from the present disclosures can have various configurations, sizes, shapes, etc., and can be utilized in conjunction with creating sharp edges for many different objects, including but not limited to scalpels, knives, combat knives, and cutting tools for sugar refinement, salt refinement, cutting plastic, cutting wood, cutting metal, and cutting rocks, among other uses.

The present disclosure generally relates to systems, compositions, and methods for manufacturing materials having sharp edges. The material can undergo severe plastic deformation at a tip thereof to allow for a sharp edge to be formed thereon having a high strength and hardness. Deformation can change the microstructure of the material by exerting a compressive force onto the heterogeneous particles to narrow grain boundaries therebetween, thereby creating a more homogeneous microstructure. In some embodiments, the increased homogeneity can be achieved without removing or otherwise substantially changing the mass of the material. For example, deformation at the edge decreases a size of the gaps within the granular microstructure of the material, which allows the deformed material to have improved hardness and resistance to cracking. In an exemplary embodiment, the material can be passed through one or more pairs of opposed tapered rolls to exert the pressure to locally deform the material. The tapered rolls can be configured to rotate to drive the material in the direction of rotation to pass the material between pairs of opposed tapered rolls. The deformed material can have at least one notch formed therein that can be used as a sharp edge in razors, scalpels, and the like.

As discussed above, conventional processes for making sharp edges involve honing a metal material, which reduces the mass of the metal by removing portions thereof. In honing, heterogeneity of the blade remains unchanged, which does not improve hardness or susceptibility to cracking. Moreover, the honing procedure modifies the shape of the material into a wedge, but the material that composes the blade is the same material produced through the heat treatment, usually a carbide-rich martensitic stainless steel. In some instances, honing the metal can cause excess thinning, which can make the material more likely to crack.

A person skilled in the art will recognize that steel at the tip of conventional razor blades can be highly heterogeneous. For example, conventional razor blades have a tip coated with several layers, including a hard diamond-like carbon coating to improve wear resistance and a Teflon coating to reduce friction. These razor blades use martensitic stainless steel that are honed down into a wedge geometry to form the sharp edge that is used for cutting. However, in the case of martensite, the mechanical properties can change from point to point. Further, while the steel has a high average hardness, the strength and/or hardness varies from region to region within the material depending on the several microstructural features that are present, e.g., martensite, retained austenite, and/or carbides contained within the material. These variations in hardness and/or strength can lead to variations at the tip of the blade, which can lead to bumps that render these sharp edges less effective for their intended purposes.

Despite these measures to improve wear resistance and the fact that steel is 50 times harder than human hair, razors rarely last more than a few weeks before requiring disposal and replacement. The hair and steel have a complex interaction that involves chipping. For example, during shaving or other grooming procedures, when the blade is titled at an angle with respect to the hair, as is common when used in conventional shaving methods, the hair exerts an out-of-plane stress onto the razor that leads to chipping after repeated use.

FIG. 1 illustrates the heterogeneity of an edge of a conventional razor blade 10. As shown, the conventional razor blade 10 is made up of a material having multiple regions 12 of varying hardness. For example, the regions 12 of the blade 10 can be characterized as being "soft," "semi-hard," "very hard," and so forth. A person skilled in the art will recognize that in the case of materials used in conventional razors, a range of hardness for the "soft" regions A can be approximately in the range of about 4,000 Newtons per square millimeter to about 7,000 Newtons per square millimeter, a range of hardness for the "semi-hard" regions B can be approximately in the range of about 7,000 Newtons per square millimeter to about 10,000 Newtons per square millimeter, and a range of hardness for the "very hard" regions C can be approximately in the range of about 10,000 Newtons per square millimeter to about 15,000 Newtons per square millimeter.

The material of the conventional razor blade 10 is typically highly heterogeneous. As shown, the surface of the material is speckled with bumps prior to use. The material can have regions A, B, and C that are randomly interspersed throughout the material such that each of regions A, B, and C border another of regions A, B, and C without consistency. When hair or another material contacts one of the many boundaries between regions of various hardness, splintering or cracking can occur and propagate throughout the material. For example, in the case of razor blade 10, when hair pushes against soft region A at a boundary 14 between the soft region A and the semi-hard region B, or the soft region A and the very hard region C, the boundary 14 is stressed. Repeated stresses to the boundary 14 can case cracks to form within the blade 10. A person skilled in the art will recognize that cracks are more likely to form at boundaries between regions of different hardness, such as the boundary 14 between region A and region B, region A and region C, and region B and region C. Due to the heterogeneous nature of the blade 10, as shown in FIG. 1, the edge will remain heterogeneous even when the material is honed. Moreover, because regions A, B, and C are interspersed throughout the blade 10, as shown in FIG. 1, the blade is susceptible to crack formation and propagation throughout when hair and other material contacts one or more of regions A, B, C. Decreasing the heterogeneity of the material, especially at the tip at the radius length scale, as discussed above, can improve blade quality and decrease the likelihood for fracture and/or cracking of the blade.

Figure 2:
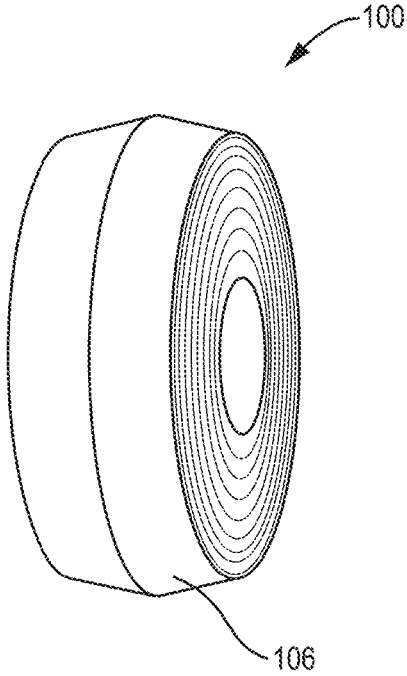
FIG. 2 is a perspective view of one exemplary embodiment of a tapered roll used in the instantly disclosed system to deform metals.

FIG. 2 illustrates an exemplary embodiment of a tapered roll or drum 100 that can be used to deform a material 102. The tapered roll 100 can be configured to abut a surface 104 of the material 102 to exert a force that locally deforms the surface 104 thereof via severe plastic deformation. As shown, the tapered roll 100 can include a substantially cylindrical outer body 106 along which the material 102 can travel. A person skilled in the art will recognize that the roll 100 can rotate as the material 102 is passed thereon to exert a substantially uniform force onto the material 102. The tapered roll 100 can be made of steel, stainless steel, and/or ceramic materials including but not limited to nitrides or carbides, such as tungsten carbide.

Figure 3:
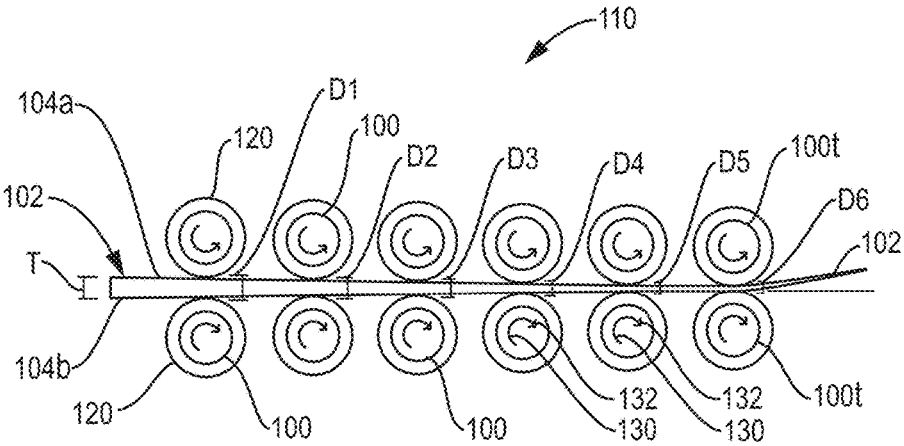
FIG. 3 is a schematic side view of a sequential tapered roll system utilizing multiple tapered rolls of FIG. 2.

The roll 100 can be used in pairs or sets, e.g., such that the material passes between a set of rolls and/or in a system in which the tapered rolls are sequentially and/or laterally aligned, e.g., one after another, to deform the material until desired blade parameters are achieved. FIG. 3 illustrates an exemplary embodiment of such a system 110 of manufacturing a sharp edge. As shown, the system 110 can use sequentially positioned pairs, or sets, of tapered rolls 100 to deform the material 102 driven therebetween. The system 110 can have one or more pairs of tapered rolls 100 that are positioned laterally, e.g., in an assembly line form, to deform the material 102. As shown, each roll 100 of pair of tapered rolls can be positioned on an opposite side of the material 102 such that the material 102 is positioned therebetween, with each roll 100 contacting an opposite surface 104*a*, 104*b* of the material 102. The tapered rolls 100 can be configured to rotate to drive or move the material 102 downstream to a downstream pair of tapered rolls. Each roll 100 of the pair of rolls can rotate in opposite directions to drive the material 102 downstream to the next pair of opposed rolls 100.

Each pair of downstream rolls 100 exerts a force onto the material 102 to locally deform the material 102 as it is driven downstream. As shown, the material 102 disposed between the first pair of opposed rolls 100 of the system 110 has a thickness T that gradually decreases as the material 102 travels through the system 110. Moreover, a distance between each downstream pair of opposed rolls 100 can decrease to accommodate a smaller thickness T of the material therebetween. For example, in the illustrated embodiment the distance D1 between the rolls 100 in the first pair of opposed tapered rolls as measured from an apex 120 along opposed surfaces 106 of each roll 100 of the first pair of opposed tapered rolls is greater than a distance D2 between each roll 100 of the at least one additional pair of opposed tapered rolls located downstream of the first pair of opposed tapered rolls as measured from an apex along opposed surfaces of each roll of the at least one additional pair of opposed tapered rolls 100. In the illustrated embodiment the distance between each subsequent downstream pair of opposed tapered rolls, e.g., D3, D4, D5, D6, decreases as the material travels downstream through the system 110. A person skilled in the art will recognize that although the distance between the rolls are being described as measured from the apex 120, a distance between the rolls 100 can be measured between any corresponding points, e.g., the centers of the rolls, top or bottom surfaces of the rolls, and so forth.

Further, while the above-illustrated embodiment includes six pairs of opposed tapered rolls, a person skilled in the art will recognize that the system 110 can include any number of opposed tapered rolls 100. For example, in other instances, there may be seven pairs, eight pairs, nine pairs, ten pairs, or even more (or less). It will be appreciated that in embodiments in which multiple pairs of opposed tapered rolls are used, each pair of opposed tapered rolls can impart a gradual deformation onto the material to prevent abrupt cracking of the material 102 from excessive force. Still further, a person skilled in the art, in view of the present disclosures, will understand that a distance between two rolls within a pair, as well as a distance between sequential pairs of rolls in a line of pairs of rolls (i.e., a second pair of rolls that is downstream from a first pair of rolls), can be altered or otherwise adjusted based on a variety of factors, including but not limited to the distances between pairs before and after a pair, the desired configuration of the material, and the configuration of each roll of the pair. The distance between a terminal pair of rolls 100*t* can be effectively zero for example, meaning that the rolls can be touching, or nearly touching (e.g., within one millimeter of each other), such that a material passing therethrough may separate into two or more separate pieces. The distance between the terminal pair of rolls can impact whether the two blades are split by the rolls themselves (e.g., when they are touching, the rolls can split the material into two blades) or whether they are split after the deformation (e.g., when the distance between the rolls of the terminal pair is far enough apart such that they do not split the blades).

The tapered rolls 100 can include one or more indicators 130 that show which direction the rolls 100 rotate, or the direction in which the material 102 is driven. For example, as shown in FIG. 3, the rolls 100 can include labels or images thereon to indicate the direction of rotation. In some embodiments, each pair of rolls can include a first image of an arrow 132 pointing in a direction. For example, the bottom roll 100 of a pair of rolls can point in the clockwise direction while the top roll 100 of the pair of rolls can point in the counterclockwise direction to indicate that the material is traveling from left to right. A person skilled in the art will recognize that for materials that travel right to left, the bottom roll 100 of a pair of rolls can point in the counterclockwise direction while the top roll 100 of the pair of rolls can point in the clockwise direction. It will be appreciated other images can be used instead or in addition, such as text labels, e.g., that read "rotates clockwise," other drawings, and the like. It will also be appreciated that the label(s) can appear on only one roll 100 of a pair of rolls, on one roll in the system 100, or not at all.

While each roll 100 in the pair of opposed rolls is shown as having the same configuration, it will be appreciated that properties such as size, shape, material, and so forth of each roll in the opposed pair of tapered rolls can differ. Similarly, the size, shape, material, and so forth of each roll in the additional pair of opposed tapered rolls can differ from one another, from the rolls in the first pair of tapered rolls, and/or from the rolls in subsequent pair of opposed tapered rolls. The various properties of rolls 100 that can be used in the instantly disclosed system are discussed in greater detail below.

Some non-limiting examples of the material 102 that can be deformed using the instantly disclosed system 110 can include pure iron, steel, stainless steel, copper, martensite, chromium, carbides, nitrides, metallic glasses, polymers, pearlite, cementite, martensitic steel, aluminum, pearlitic steel, titanium, nickel, cobalt, hydroxyapatite, silver, and/or gold, as well as any combinations thereof. The type of material used can depend, at least in part, on the intended purpose and/or sharpness of the material 102. For example, for sharp edges used in scalpels, one might want to consider other bio-compatible materials that are suitable to be received in the human body during surgical procedures. Moreover, in some embodiments, severe plastic deformation can induce cementite dissolution in pearlitic steels, as well as $M_{23}C_6$ carbides to transform into $M_6C$ due to the dissolution of atoms in the matrix. In such embodiments, where stress levels are increased, full dissolution of carbides can be achieved.

Figure 4:
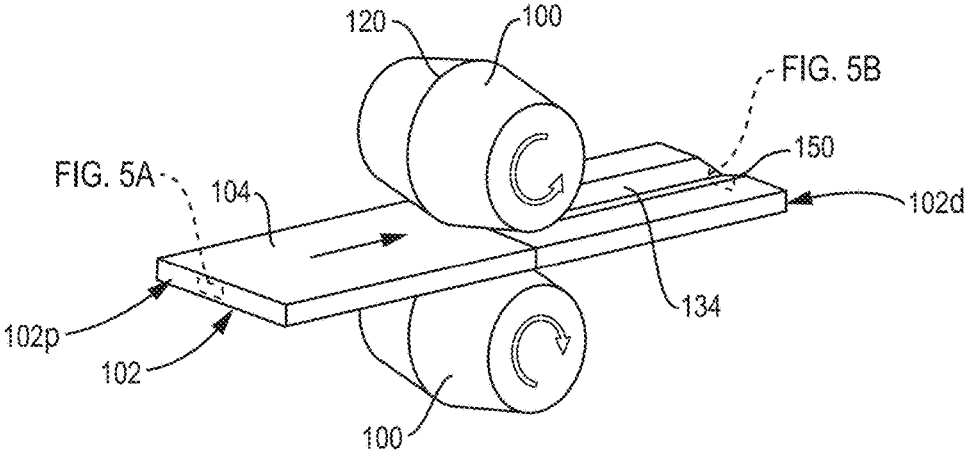
FIG. 4 is a schematic perspective view of one exemplary embodiment of a set of tapered deforming a material therebetween.

The deformation of the material 102 that results from contact with the tapered roll 100 is seen in greater detail in FIG. 4, which illustrates a pair of rolls 100 deforming a piece of the material 102 disposed between the rolls 100. Deformation of the material 102 via the system 110 discussed above can cumulatively deform the initial material 102 from having a rectangular cross-section to an "hourglass cross-section," as shown below. Deformation of the material 102 occurs when the material 102 is placed between the pair of opposed rolls 100 and driven downstream in the direction of the arrow. The orientation of the tapered rolls 100 relative to the material 102 can localize the deformation in a central region 134, e.g., the region in contact with the two rolls 100, while the remaining surfaces 104 are typically not modified with any significance and thus retain the properties of the starting material. It will be appreciated that in some embodiments the orientation of the rolls 100 with respect of the material can change, for example, based on a desired position of the deformation along the surface of the material 102. As mentioned above, no material is removed during deformation. Rather, the material 102 is locally deformed to form the final wedge shape by compressing the microstructure of the material 102. After deformation, the material 102 can be driven downstream to the next pair of opposed tapered rolls 100 for further deformation, as discussed with respect to FIG. 3 above.

Figure 5A:
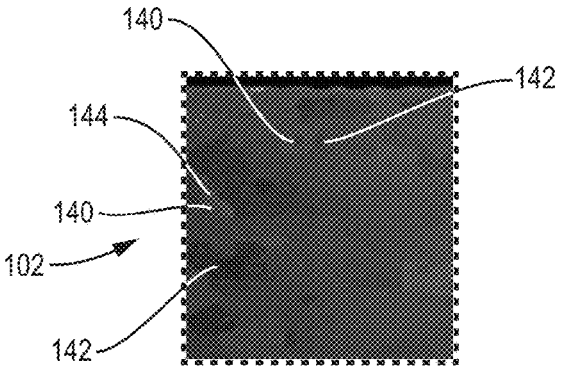
FIG. 5A is a scanning electron microscope image of a cross-sectional view of a portion of the material in FIG. 4 prior to deformation.
Figure 5B:
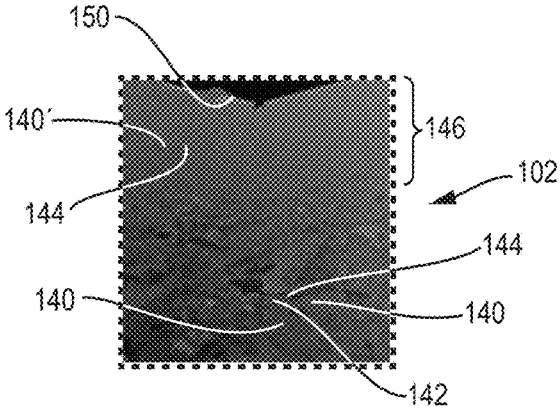
FIG. 5B is a scanning electron microscope image of a cross-sectional view of a portion of the material in FIG. 4 after deformation, illustrating a notch formed therein.

FIGS. 5A and 5B illustrate a cross-sectional view of the material 102 before and after deformation by the tapered roll 100 of FIG. 4. As shown in FIG. 5A, the microstructure of the material 102 is composed of large grains 140 of various sizes and shapes. The size of the grains 140 leaves them interspersed throughout the material 102 with one or more spaces 142 therebetween. Due to irregularities in shape of individual grains 140, grain boundaries 144 between two or more grains 140 are uneven, thereby creating spaces 142 at these grain boundaries 144. Moreover, as discussed above with respect to FIG. 1, the grains 140 from which these materials are composed can vary in hardness. Stresses at these grain boundaries 144, when performed at specific angles, can exert an uneven force on the grain boundaries 144, causing friction and relative movement of the grains 140 at the boundaries 144.

FIG. 5B is an exemplary embodiment of the material 102 having undergone local deformation by the tapered roll 100 at a distal end 102*d* thereof. As shown, the distal end 102 includes a refined region 146 that includes a notch 150 that forms a sharp edge. As shown, the refined region 146 includes deformed grains 140' that have been compressed to reduce the size thereof to create a substantially homogeneous microstructure, e.g., the deformed grains 140' in the refined region 146 are of a substantially uniform size. As shown, the size of the deformed grains 140' in the refined region 146 is significantly smaller than the non-refined region at a proximal end 102*p* of the material 102. Moreover, the size of the deformed grains 140' in the refined region 146 decreases through a length of the material 102, with the deformed grains 140' being located proximate to the notch 150. A person skilled in the art will recognize that the material 102 having a substantially homogeneous microstructure, and/or the deformed grains 140' in the refined region 146 being of a substantially uniform size, suggests that the size of each grain in the deformed grains 140' is approximately 75% of the average grain size of the deformed grains, or the size of each grain in the deformed grains 140' is approximately 90% of the average grain size of the deformed grains, or the size of each grain in the deformed grains 140' is approximately 95% of the average grain size of the deformed grains, or the size of each grain in the deformed grains 140' is approximately 100% of the average grain size of the deformed grains, or the size of each grain in the deformed grains 140' is approximately 110% of the average grain size of the deformed grains, or the size of each grain in the deformed grains 140' is approximately 115% of the average grain size of the deformed grains, or the size of each grain in the deformed grains 140' is approximately 125% of the average grain size of the deformed grains. Further, the size of the deformed grains 140' can be approximately 25% of the size of the grains 140, though in some embodiments, the size of the deformed grains 140' can be approximately 15% of the size of the grains 140, or the size of the deformed grains 140' can be approximately 10% of the size of the grains 140, or the size of the deformed grains 140' can be approximately 5% of the size of the grains 140, or the size of the deformed grains 140' can be approximately 1% or below of the size of the grains 140.

The reduced size of the deformed grains 140' enables the grains to be tightly packed together to fill the former spaces 142, thereby resulting in the substantial elimination of these spaces between the deformed grains 140'. Absence of spaces between the deformed grains 140' allows the material 102 to exhibit superior alignment therebetween, producing grain boundaries 144' in the central region 134 that are less prone than their macroscopic counterparts to result in failure. The packing of the deformed grains 140' can also strengthen the material 102 in the refined region 146 due, at least in part, to the greater density of load-bearing microstructures therein. In embodiments in which the material 102 is pearlitic steel, for example, strengthening of the refined region 146 can occur through the Hall-Petch effect (dislocation pile-up at phase boundary during plastic deformation), composite effect (plastic co-deformation of nano-size cementite plates with the ferritic ones), interface strengthening (carbon content changes gradually between the two phases), and/or solid solution strengthening (supersaturated ferrite). In the illustrated embodiment the strength, as well as hardness, of the material 102 is greatest proximate to the notch 150 at the distal end 102*d* and gradually decreases moving away from the distal end 102*d*.

A person skilled in the art will recognize that a size of the refined region 146 can vary based, at least in part, on a location of the tapered roll(s) 100 relative to the material 102, as well as the material 102 itself. As shown, the refined region 146 is limited to the portion of the material 102 that was compressed by the tapered roll 100. For example, in some embodiments, the refined region 146 can be as large as about 350 μm, though the size can increase or decrease based, at least in part, on a size of the tapered roll 100, the number of rolls in the system 110, the placement of the roll 100 relative to the material 102, and so forth.

Figure 6A:
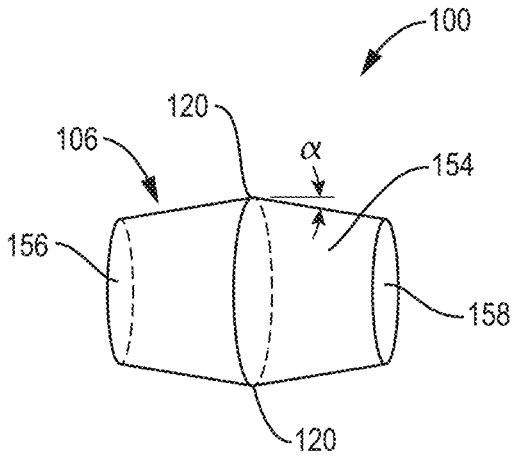
FIG. 6A is a schematic front view of one exemplary embodiment of a tapered roll, the tapered roll having a tapered angle.

The notch 150 as shown has a specular V-shape, though in some other embodiments the notch can be U-shaped, wedge-shaped, and so forth. The size and angle of the notch 150 can be modified based, at least in part, on a desired sharpness of the tip of the material 102. For example, to vary a sharpness of the tip of the material 102, the angle of the taper in the tapered roll 100 can be varied. FIG. 6A illustrates the tapered roll 100 in greater detail. The substantially cylindrical body 106 of the tapered roll 100 can include an outer surface 154 that extends between a first end 156 and a second end 158. In some embodiments, the tapered roll 100 can resemble two sections of a cylinder that are oriented to abut one another to form the body 106. As discussed above, the body 106 can taper to an apex 120 that is positioned at an approximate center of the tapered roll 100 such that the taper of the body 106 between the first end 156 and the second end 158 is symmetrical, as shown. Alternatively, in some embodiments the apex 120 can be more proximate to the first end 156 than the second end 158, or vice versa. The outer surface 154 of the tapered roll 100 can be angled such that a taper is formed along the body 106. As shown, the outer surface 154 can have a tapering angle, a, from the apex 120 towards the first and second ends 156, 158. The tapering angle α can deform the material 102 to form a tip having a high resistance at the edge during cutting. For example, the tapering angle α can be approximately in the range of about 5 degrees to about 30 degrees, although in some instances the tapering angle may be even less, such as about 3 degrees, or greater, such as at least about 60 degrees. Smaller angles can generally provide for sharper edges and larger angles can generally provide for greater load to be imparted on the blade, and thus, on the object on which the blade becomes a part (e.g., the knife that includes the blade). For example, a small angle can be used to produce very sharp blades, which can be desirable in the case of making razor blades and scalpels, a medium angle can be used to produce sharp but also resistant edges, which can be desirable for knives that need to bear high loads during the cut, and a large angle can be used to produce very damage-resistant and durable cutting tools, which can be desirable for manufacturing of goods, for example, salt refinement tool and/or cutting tools for plastic and wood. In some embodiments, any or all pairs of rolls can include a flat roll and a tapered roll with a tapering angle as provided for herein such that a final sharp object presents a "chisel edge" rather than a "V-edge," with a "chisel edge" in a cross-sectional view being configured to look like half of a "V," with one side forming a substantially straight vertical portion (for example, like this: |/).

A person skilled in the art will recognize that some non-limiting examples of factors that can impact the selected tapering angle, the number of tapered roll pairs, distances between rolls in a single pair, and distances between sequential pairs of rolls can include, but are not limited to, the desired hardness and sharpness of the edge, the type of material(s) on which the edge(s) is being formed (e.g., aluminum, steel), and/or the ultimate use of the edge (i.e., is the formed edge going to be used to cut a particularly hard material, a materials that is traditionally difficult to cut through, etc.).

Figure 6B:
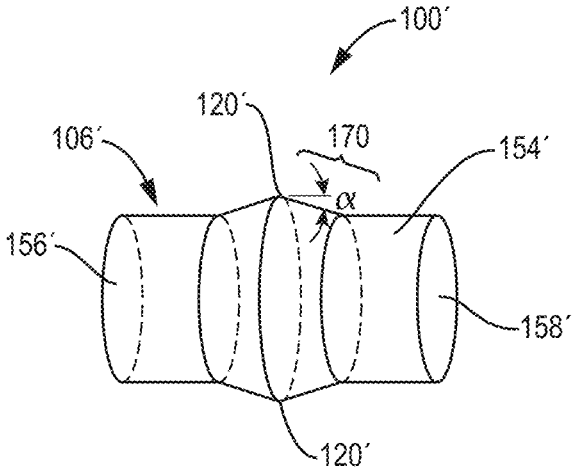
FIG. 6B is a schematic front view of another exemplary embodiment of a tapered roll, the tapered roll having a tapered angle.

FIG. 6B illustrates a roll 100' that includes a tapered middle portion 170. As shown, the taper can extend from the apex 120' through a distance of the body 106' that is smaller than a distance between the apex 120' and either of the first or second ends 156', 158'. That is, the tapering angle α can terminate prior to the first and/or second ends 156', 158', with the outer body 154' extending from the taper substantially perpendicularly to each of the first and second ends 156', 158'. Such a configuration can provide localized deformation only in a certain region (e.g., where the sharp edge of the blade will be), which can allow for the production of a large body of a knife, for instance, with substantially constant thickness and a final sharp edge located in a specific position. The taper of the tapering angle α can be the same as discussed above with respect to FIG. 6A, though, in some embodiments the angle can be smaller or greater. As discussed above with respect to FIG. 3, a person skilled in the art will recognize that the tapering angle α of the terminal pair(s) of rolls can differ from the tapering angle of the pairs upstream from them. For example, the tapering angle of the last pair, or last pairs, of rolls can be different than the tapering angle for the initial pair, or initial pairs, of rolls. Such configurations can provide for a possible "separation" in two sides and/or impart a specific angle at a distal-most tip of a sharp edge.

Figure 6C:
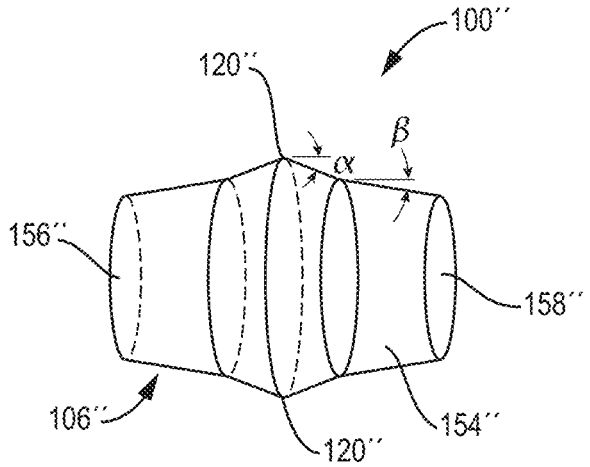
FIG. 6C is a schematic front view of yet another exemplary embodiment of a tapered roll, the tapered roll having two tapered angles.

The tapered rolls of the present disclosure can have a plurality of tapering angles. For example, FIG. 6C illustrates a tapered roll 100" having the tapering angle α and a second tapering angle β. As shown, the second tapering angle β can begin when the tapering angle α terminates, with the outer surface 154" continuing to taper at the second tapering angle β until the first and second ends 156", 158". The total taper of the outer surface 154" of the body 106" in embodiments having both tapering angles α, β can result in a large overall angle, making such embodiments useful for industrial applications such as the manufacture of kitchen knives, cutting tools for plastic sheets as well as other industrial applications. A person skilled in the art will recognize that in some embodiments, the second tapering angle β can terminate prior to the first and second ends 156", 158". In some embodiments, the tapered roll can include a third and/or fourth tapering angle and/or other configurations of angles are possible.

Figure 6D:
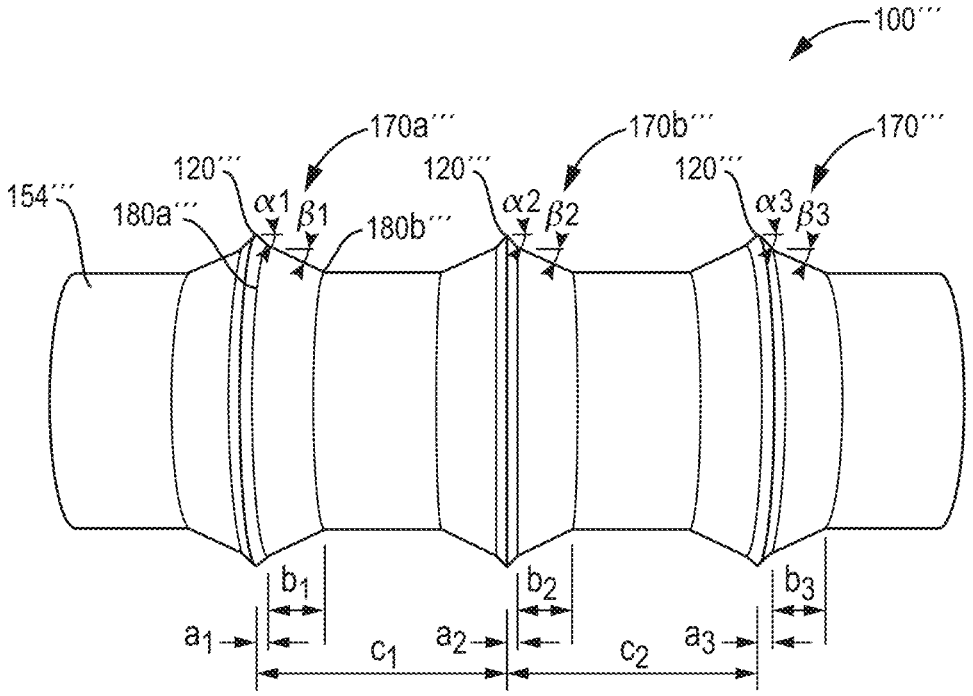
FIG. 6D is a schematic front view of another exemplary embodiment of a tapered roll, the tapered roll having three sets of tapers.

In some embodiments the tapered roll can include a plurality of tapers 170''' in each roll. FIG. 6D illustrates an embodiment of a tapered roll 100''' having three tapers 170''' formed therein. The multiple tapers 170''' can be used to produce multiple sharp edges while using a single roll, as discussed below. For example, the tapered roll 100''' can be used to produce cutting instruments having more than two sharp edges simultaneously. The three tapers 170''' can be used to manufacture six sharp edges, e.g., two edges for each taper, though it will be appreciated that, in some embodiments, the number of tapers and the number of edges in each taper can be varied. In some embodiments, a third tapering angle (not shown) can be used in the tapers 170''' of the roll 100', resulting in the material forming three edges per taper 170'''. Moreover, the tapered roll 100''' can include two or four or more tapers, which a person skilled in the art would recognize can result in a material having four edges or eight or more edges, respectively. The tapered roll 100''' can therefore be used as one of a series of laterally disposed rolls in the system 110, or as a roll in a single set of opposed pair of rolls used to deform the material 102.

The tapers 170''' can be spaced apart from one another by one or more distances c1, c2. The distances c1, c2 can be measured between the apexes 120''' of each taper 170', as shown, though in some embodiments the distances c1, c2 can be measured between respective starting points of the tapers, the termination of tapers, and/or any corresponding points of the taper. Moreover, while the distances c1, c2 are shown as being substantially equal, in some embodiments the distance c1 can be greater than the distance c2, and vice versa. Some non-limiting examples of values of the distances c1, c2 can be approximately in the range between about 1 millimeter to about 500 millimeters, or approximately in the range of about 10 millimeters to about 200 millimeters, the values of the distances c1, c2 being varied based on the purpose of the edges being produced.

As shown, the tapered roll 100' can resemble the tapered roll 100" in that each taper 170''' of the tapering roll 100' includes a first tapering angle α1, α2, α3 and a second tapering angle β1, β2, β3. In some embodiments, and as in the embodiment of FIG. 6C, the second tapering angles β1, β2, β3 can begin when the first tapering angles α1, α2, α3 terminate, with the outer surface 154' continuing to taper at the second tapering angles β1, β2, β3.

In some embodiments, the tapered roll 100''' can include one or more junctions 180' in the outer surface 154''' of the tapered roll 100''' at which the tapering angles α1, α2, α3, β1, β2, β3 terminate. For example, as shown in FIG. 6D, the first tapering angle α1 can extend from an apex 120' of a first taper 170*a*''' through a first distance a1, with a1 measuring a distance between the apex 120''' and a first junction 180*a*". Some non-limiting examples of values of the distance a1 can be approximately in the range of about 0.001 millimeters to about 100 millimeters. As discussed above, the second tapering angle β1 of the first taper 170*a*''' can begin when the first tapering angle α1 terminates, e.g., at the first junction 180*a*''', and terminates at a second junction 180*b*'''. The second tapering angle β1 can extend through a second distance b1, with b1 being measured between the first junction 180*a*''' and the second junction 180*b*'''. Some non-limiting examples of values of the distance b1 can be approximately in the range of about 0.001 millimeters to about 100 millimeters. Distances of the tapering angles α2, α3, β2, β3 of the second taper 170*b*''' and the third taper 170*c*''' are measured by distances a2, b2, a3, b3, respectively. A person skilled in the art will recognize that the above-described configurations can apply correspondingly to the second and third tapers 170*b*''', 170*c*'''. Moreover, one or more values of the tapering angles α1, α2, α3, β1, β2, β3, as well as the distances a1, b1, a2, b2, a3, b3, can be the same and/or different from the values of any other of the tapering angles α1, α2, α3, β1, β2, β3, and the distances a1, b1, a2, b2, a3, b3 at least within the ranges specified with respect to this embodiment.

Figure 7A:
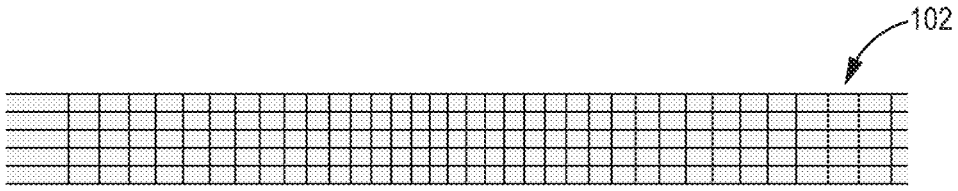
FIG. 7A is schematic cross-sectional view of the material in FIG. 4 prior to deformation.
Figure 7B:
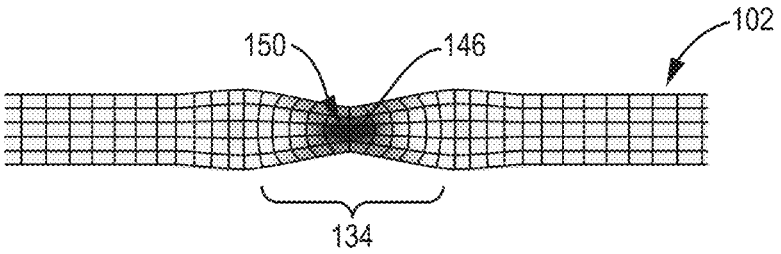
FIG. 7B is a magnified perspective view of the material in FIG. 7B after deformation.

FIGS. 7A and 7B illustrate a cross-section of the material 102 undergoing deformation by the first tapered roll 100. FIG. 7A illustrates the material 102 prior to deformation, e.g., upstream of the first tapered roll 100, while FIG. 7B illustrates the material 102 having the central region 134 deformed into the refined region 146 after deformation by the first tapered roll 100, e.g., downstream of the first tapered roll. As shown, the material 102, once deformed, can have an hourglass shape with the deformation being localized in the central region 134 thereof, which corresponds to the region that was compressed with the tapered roll 100.

The refined region 146 has substantially the same amount of material and/or mass as prior to deformation. That is, substantially no material was removed as a result of contact with the tapered roll 100. A person skilled in the art will recognize that the material having substantially the same mass of the material and substantially no material being removed suggests that the deformed material has at least about 90% of the mass of the material prior to deformation, though in some embodiments, or the mass of the deformed material can be at least about 95% of the mass of the material prior to deformation, or at least about 97% of the mass of the material prior to deformation, or at least about 99% of the mass of the material prior to deformation, or at about 100% of the mass of the material prior to deformation. The refined region 146 can then be driven downstream for further deformation by the additional opposed pairs of tapered rolls. Once the material 102 is sufficiently deformed, the material can be separated such that two sharp edges are produced, one on each side of the hourglass shape shown in FIG. 7B. Each of these sharp edges can be used as blades in a razor, in a knife, and other similar purposes.

Local deformation of the material 102, as shown by the refined region 146 located in the central region 134 of the material, results in a microstructure of the material 102 at the tip of the newly formed sharp edge that differs from the microstructure located farther from the notch 150. Local deformation by tapered rolls therefore allows for targeting specific properties of the material where desired. For example, the material 102 can be customized to have a high hardness and resistance at the notch 150, with softer, more flexible material farther from the notch 150. A person skilled in the art will recognize that such a difference in mechanical properties cannot be obtained with the current honing process because the heat treatment applied during honing is homogeneous throughout the blade and would therefore be applied across an entire length of the material.

Figure 8:
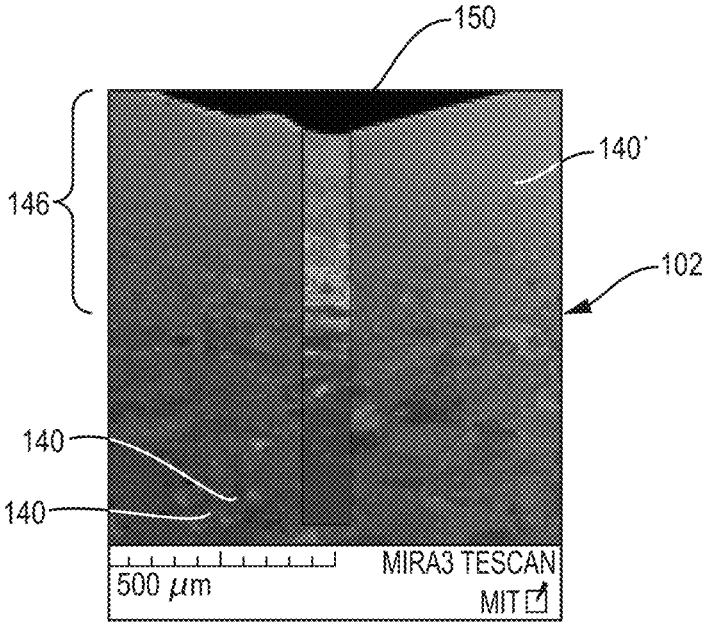
FIG. 8 is a scanning electron microscope image of a cross-sectional view of a portion of the material in FIG. 4 after deformation, illustrating a variation in hardness within the material.

FIG. 8 illustrates a heat map of the variation in hardness across the deformed material 102. As shown, the softer, more flexible material located farther from the notch 150 maintains the grains 140 of a larger grain size, with the hardness of the material 102 increasing gradually as the prevalence of the deformed grains 140' increases along the material 102 within the refined region 146 closer to the notch 150. The refined region 146 closer to the notch 150 exhibits the greatest amount of deformation, and correspondingly, maximum hardness. The homogeneity of the deformed grains 140' in this refined region 146 is substantially uniform.

Examples of the above-described embodiments can include the following:

1. A deformed material, comprising:

a length of metallic material, the length of metallic material having a substantially homogeneous microstructure in at least a deformed portion thereof, the substantially homogenous microstructure having a plurality of deformed grains of a substantially uniform size that are smaller in size than the grains in one or more of a non-deformed portion of the length of metallic material and the grains in the deformed portion prior to deformation.

2. The deformed material of example 1, wherein the length of metallic material includes one or more of pure iron, steel, stainless steel, copper, martensite, chromium, carbides, nitrides, metallic glasses, polymers, pearlite, cementite, martensitic steel, aluminum, pearlitic steel, titanium, nickel, cobalt, hydroxyapatite, silver, or gold.

3. The deformed material of example 1 or claim 2, wherein the size of the plurality of deformed grains is approximately in the range of about 75% of the average grain size of the deformed grains to about 125% of the average grain size of the deformed grains.

4. The deformed material of any of examples 1 to 3, wherein the size of the deformed grains is approximately 25% of the size of the grains in the non-deformed portion.

5. The deformed material of any of examples 1 to 3, wherein the size of the deformed grains is approximately 25% of the size of the grains prior to deformation.

6. A system for manufacturing a sharp edge, comprising:

a first pair of opposed tapered rolls configured to rotate to drive a material disposed therebetween downstream, the tapered rolls having one or more features configured to deform the material while the material is being driven downstream; and at least one additional pair of opposed tapered rolls disposed laterally downstream of the first pair of opposed tapered rolls and configured to rotate to drive a material received from the first pair of opposed tapered rolls downstream, wherein each roll of the first pair of opposed tapered rolls comprises a somewhat cylindrical configuration that includes a first end, a second end, and an apex, with the opposed surface of each roll being tapered between the first end and the apex and between the second end and the apex, and wherein a distance between each roll of the first pair of opposed tapered rolls as measured from an apex along opposed surfaces of each roll of the first pair of opposed tapered rolls is greater than a distance between each roll of the at least one additional pair of opposed tapered rolls as measured from an apex along opposed surfaces of each roll of the at least one additional pair of opposed tapered rolls.

7. The system of example 6, wherein the one or more features further comprise a first tapering angle that extends along an outer surface of the tapered roll between the apex and one or more of the first end and the second end of the tapered roll, the apex and the outer surface of the tapered roll being configured to exert a compressive force to deform the material.

8. The system of example 7, wherein a value of the first tapering angle is approximately in the range of about 3 degrees to about 60 degrees.

9. The system of example 8, wherein a value of the first tapering angle is approximately in the range of about 5 degrees to about 30 degrees.

10. The system of example 7, wherein the tapered roll includes a second tapering angle that extends between the first tapering angle and one or more of the first end and the second end of the tapered roll, the tapering angle having a value that is different from a value of the first tapering angle.

11. The system of any of examples 6 to 10, wherein the at least one additional pair of opposed tapered rolls comprises at least five pairs of opposed tapered rolls, each pair being disposed downstream from one another, and the distance between each roll of the respective pair of the at least five pairs of opposed tapered rolls decreases for each subsequent downstream pair of the at least five pairs of opposed tapered rolls.

12. The system of any of examples 6 to 11, wherein the distance between each roll of a terminal pair of opposed tapered rolls of the at least one additional pair of opposed tapered rolls is effectively zero.

13. The system of any of examples 6 to 12, wherein the material includes one or more of pure iron, steel, stainless steel, copper, martensite, chromium, carbides, nitrides, metallic glasses, polymers, pearlite, cementite, martensitic steel, aluminum, pearlitic steel, titanium, nickel, cobalt, hydroxyapatite, silver, or gold.

14. The system of any of examples 6 to 13, wherein each roll of the first pair of opposed tapered rolls rotates in a direction opposite of the opposite tapered roll of the first pair of opposed tapered rolls to drive the material downstream.

15. The system of any of examples 6 to 14, wherein substantially no portion of the material is removed during deformation.

16. The system of any of examples 6 to 15, wherein a mass of the deformed material is substantially the same as a mass of the material prior to deformation.

17. The system of any of examples 6 to 16, wherein at least one roll of the first pair of opposed tapered rolls includes a plurality of tapers, each taper having a plurality of tapering angles.

18. A method of manufacturing an edge, comprising:

feeding a length of metallic material between a first pair of opposed tapered rolls; and rotating the first pair of opposed tapered rolls to advance the length of metallic material therethrough, the pair of opposed tapered rolls causing local deformation on both sides of the length of metallic material, the length of metallic material splitting to form two metallic pieces, each metallic piece having a sharp edge that includes a localized deformed region.

19. The method of example 18, further comprising:

receiving the length of metallic material between at least one additional pair of opposed tapered rolls disposed laterally downstream of the first pair of opposed tapered rolls; and rotating the at least one additional pair of opposed tapered rolls to advance the length of metallic material received therethrough downstream, the additional pair of opposed tapered rolls causing further local deformation on both sides of the length of metallic material.

20. The method of example 19, wherein rotating the first pair of opposed tapered rolls and the at least one additional pair of opposed tapered rolls to advance the length of metallic material laterally therethrough forms two specular V-shaped notches along the length of metallic material.

21. The method of example 19 or claim 20, wherein a portion of an outer surface of the first pair of opposed tapered rolls between an apex and one or more of a first end and a second end of the first pair of opposed tapered rolls that includes a first tapering angle engages the length of metallic material to deform both sides of the length of metallic material.

22. The method of any of examples 18 to 21, further comprising positioning the length of metallic material relative to the first pair of opposed tapered rolls at a predetermined location along the length of metallic material such that an edge is formed at the predetermined location.

23. The method of example 22, wherein substantially no local deformation occurs along the length of metallic material outside of the predetermined location.

24. The method of any of examples 18 to 23, wherein substantially no portion of the length of metallic material is removed during deformation.

25. The method of any of examples 18 to 24, wherein a mass of the length of metallic material after deformation is substantially the same as a mass of the material prior to deformation.

26. The method of any of examples 18 to 25, wherein the length of metallic material comprises copper.

27. The method of any of examples 18 to 26, wherein the length of metallic material comprises one or more of stainless steel or pearlitic steel.

One skilled in the art will appreciate further features and advantages of the disclosure based on the above-described embodiments. Accordingly, the disclosure is not to be limited by what has been particularly shown and described, except as indicated by the appended claims. All publications and references cited herein are expressly incorporated herein by reference in their entirety.

What is claimed is:

1. A deformed material, comprising:

a length of metallic material having a substantially homogeneous microstructure in at least a deformed portion thereof that terminates in a sharp edge that is formed from a notch, with the homogeneity of the metallic material increasing across the length of the metallic material such that the homogeneity is highest at the notch, the substantially homogenous microstructure having a plurality of deformed grains of a substantially uniform size that are smaller in size than the grains in one or more of a non-deformed portion of the length of metallic material and the grains in the deformed portion prior to deformation.

2. The deformed material of claim 1, wherein the length of metallic material includes one or more of pure iron, steel, copper, martensite, chromium, metallic alloys containing carbides or nitrides, metallic glasses, pearlite, cementite, aluminum, pearlitic steel, titanium, nickel, cobalt, silver, or gold.

3. The deformed material of claim 1, wherein the size of the plurality of deformed grains is in the range of 75% of the average grain size of the deformed grains to 125% of the average grain size of the deformed grains.

4. The deformed material of claim 1, wherein the size of the deformed grains is in the range of 1% the size of the grains in the non-deformed portion to 25% of the size of the grains in the non-deformed portion.

5. The deformed material of claim 1, wherein the length of metallic material includes one or more of martensite containing metallic material, carbides containing metallic material, nitrides containing metallic material, polymers containing metallic material, pearlite containing metallic material, cementite containing metallic material, or hydroxyapatite containing metallic material.

6. The deformed material of claim 1, wherein a thickness of the metallic material is smaller at the notch than at the non-deformed portion of the metallic material.

7. The deformed material of claim 1, wherein the deformed portion has an hourglass cross-section.

8. The deformed material of claim 1, wherein the non-deformed portion has a rectangular cross-section.

9. The deformed material of claim 1, wherein the notch is one or more of U-shaped, wedge-shaped, or specular V-shaped.

10. The deformed material of claim 1, wherein the deformed portion is devoid of spaces between the plurality of deformed grains.

11. The deformed material of claim 1, wherein a boundary between a plurality of deformed grains occurs through one or more of dislocation pile-up at phase boundary during plastic deformation, plastic co-deformation of nano-size cementite plates with the ferritic ones, carbon content changes gradually between the two phases, or supersaturated ferrite.

12. The deformed material of claim 1, wherein one or more of a strength or a hardness is highest at the notch and gradually decreases moving away from the notch.

13. The deformed material of claim 1, wherein the deformed portion has a length up to 350 μm.

14. The deformed material of claim 1, wherein the deformed portion terminates in a notch that forms a plurality of sharp edges.

15. The deformed material of claim 1, wherein a mass of the deformed portion is substantially the same prior to deformation.

16. The deformed material of claim 3, wherein at least the sharp edge exhibits severe plastic deformation.

17. The deformed material of claim 4, wherein at least the sharp edge exhibits severe plastic deformation.

18. The deformed material of claim 1, wherein the notch comprises local deformation on both sides of the metallic material following passage of the metallic material between a first pair of opposed tapered rolls and at least one additional pair of opposed tapered rolls disposed laterally downstream of the first pair of opposed tapered rolls.

19. A deformed material, comprising:

a length of metallic material having a substantially homogeneous microstructure in at least a deformed portion thereof that terminates in a sharp edge that is formed from a notch, with the homogeneity of the metallic material increasing across the length of the metallic material such that the homogeneity is highest at the notch, the substantially homogenous microstructure having a plurality of deformed grains of a substantially uniform size that are smaller in size than the grains in one or more of a non-deformed portion of the length of metallic material and the grains in the deformed portion prior to deformation, wherein at least the sharp edge exhibits severe plastic deformation such that the size of the deformed grains is in the range of 1% the size of the grains in the non-deformed portion to 25% of the size of the grains in the non-deformed portion.

20. A deformed material, comprising:

a length of metallic material having a substantially homogeneous microstructure in at least a deformed portion thereof that terminates in a sharp edge that is formed from a notch, with the homogeneity of the metallic material increasing across the length of the metallic material such that the homogeneity is highest at the notch, the substantially homogenous microstructure having a plurality of deformed grains of a substantially uniform size that are smaller in size than the grains in one or more of a non-deformed portion of the length of metallic material and the grains in the deformed portion prior to deformation, wherein the notch comprises local deformation on both sides of the metallic material following passage of the metallic material between a first pair of opposed tapered rolls and at least one additional pair of opposed tapered rolls disposed laterally downstream of the first pair of opposed tapered rolls.

* * * * *